US005125544A

United States Patent [19]

Millner et al.

[11] Patent Number: 5,125,544

[45] Date of Patent: Jun. 30, 1992

[54] PIPETTE PUMP

[75] Inventors: Seymon N. Millner, Northbrook, Ill.; Ronald A. Mayes, Beaumont, Tex.

[73] Assignee: Helena Laboratories Corporation, Beaumont, Tex.

[21] Appl. No.: 448,274

[22] Filed: Dec. 11, 1989

[51] Int. Cl.[5] ..... B65D 47/18

[52] U.S. Cl. ..... 222/215; 222/420; 141/26

[58] Field of Search ..... 222/422, 421, 420, 481.5, 222/212, 215, 490; 141/24, 22, 25, 26; 251/342

[56] References Cited

U.S. PATENT DOCUMENTS

| | | | |
|---|---|---|---|
| 1,288,725 | 12/1918 | Somerville | 141/26 |
| 1,988,852 | 1/1935 | Miller | 141/24 |
| 2,728,232 | 12/1955 | Bremmer | 73/864.15 |
| 3,285,296 | 11/1966 | Ishimaru et al. | 141/26 |
| 3,831,823 | 8/1974 | McWhorter et al. | 222/490 |
| 4,463,616 | 8/1984 | Blecher | 141/25 |

FOREIGN PATENT DOCUMENTS

| | | | |
|---|---|---|---|
| 832342 | 2/1952 | Fed. Rep. of Germany | 251/342 |
| 1501841 | 9/1966 | France . | |

*Primary Examiner*—Michael S. Huppert
*Assistant Examiner*—Anthoula Pomrening
*Attorney, Agent, or Firm*—Spencer, Frank & Schneider

[57] ABSTRACT

A pipette pump for pipetting fluid includes an elongated hollow barrel and a pump mechanism at one end of the barrel. The pump mechanism includes a compressible portion which is actuated to fill the pipette barrel. Thereafter, the pipette barrel is vented to the atmosphere to bypass the pump mechanism such that the fluid in the pipette barrel is discharged by gravitational forces and atmospheric pressure rather than by actuation of the compressible portion of the pump mechanism. The pipette barrel may be repeatedly vented to discharge the contents of the pipette in a series of aliquots. The pump mechanism, when compresssed and not bypassed, provides rapid, positive displacement discharge of the contents of the pipette.

11 Claims, 1 Drawing Sheet

PIPETTE PUMP

BACKGROUND OF THE INVENTION

This invention relates to a form of a pipette known as a pipette pump and, more particularly, to an improvement in pipette pumps to facilitate discharge of the contents of a pipette.

There are, broadly speaking, two principal forms of pipetting. In the first form, the pipette is filled with a desired quantity of liquid and subsequently, the entire contents of the pipette are emptied either rapidly or more gradually. Regardless of whether the contents of the pipette are emptied gradually or rapidly, pipettes of this first type are quite accurate and used for precise quantitative measurements.

A second form of pipetting, frequently referred to as serological pipetting, is semi-quantitative in that a pipette is filled with a quantity of liquid and thereafter the liquid is discharged into a plurality of aliquots. This may be thought of as sequential transfer or discharge of the contents of the pipette.

The pipette equipment, which is to some extent usable either for accurate pipetting or for semi-quantitative, sequential discharge pipetting, has heretofore been of essentially two different types. In a first type of equipment, a hollow tube, or pipette, made of glass or plastic and open at both ends, has one end lowered into a fluid to be transferred until the fluid reaches a desired level within the pipette. Then, the laboratory technician covers the opposite, or open end, of the pipette, such as with a thumb or forefinger, the pipette with some liquid therein is removed, and the pipette moved to a second location. The laboratory technician then releases the top of the pipette, and the entire contents of the pipette are discharged. This type of pipette works solely by virtue of atmospheric pressure and gravitational forces. It may be appreciated that by selectively covering and releasing the top of the pipette tube, the technician may achieve a quasi-quantitative approach to sequentially discharging the contents of the pipette at a plurality of locations.

A second type of pipette, frequently called a pipette pump, includes a form of mechanical device, e.g., valves, bellows, pump, piston, plunger, wheel, etc. The pipette is placed within the fluid to be transferred, and the mechanical device is actuated to fill the pipette. Then the pipette is moved to the location where the contents are to be discharged, and the mechanical device, or pump, is actuated. Competitive products presently available usually provide alternate forms of dispensing, a rapid dispensing and a more gradual dispensing. This second type of pipette is frequently identified as a positive displacement or piston displacement pipette. Examples of prior pipettes of the type heretofore described are illustrated at page 101 of the *PGC Scientifics Catalog.* It may be appreciated that with mechanical pipette pumps, the prior art devices have heretofore provided either two alternate mechanical devices (e.g., wheel and plunger, wheel and lever) or a plurality of valves.

Pipettes which do not employ a pump mechanism are, of course, more easily emptied, but potential problems arise in the handling of corrosives and biological fluids such as blood, urine and the like. For example, because of the potential for spread of hepatitis and/or HIV virus, laboratory technicians, even though wearing latex protective gloves, frequently object to utilizing such pipettes.

Thus, prior to the present invention, there have been no satisfactory solutions to obtaining the benefits of a semi-quantitative pipette, of the type typically used with serological studies where the contents are discharged or dispensed into a plurality of aliquots, which are easy and convenient to use and which minimize the risk of exposure of the laboratory technician to the biological fluid.

SUMMARY OF THE INVENTION

The present invention overcomes these shortcomings by providing a new and improved pipette pump, primarily for sequential discharge of semi-quantitative aliquots of fluid which incorporates mechanical filling and emptying and which also permits rapid, complete discharge, all through the use of a single mechanical pump.

The present invention accomplishes these objectives by providing a new and improved pipette of the type which provides a pump mechanism for filling the pipette, the pump including a vent or release for providing gravity-type sequential or complete emptying of the contents of the pipette.

BRIEF DESCRIPTION OF THE DRAWINGS

The foregoing advantages of the present invention, together with other objects and advantages which may be obtained by its use, will become more apparent upon reading the following detailed description of the invention taken in conjunction with the drawings.

In the drawings, wherein like reference numerals identify corresponding components.

DETAILED DESCRIPTION OF THE INVENTION

Figure 1:
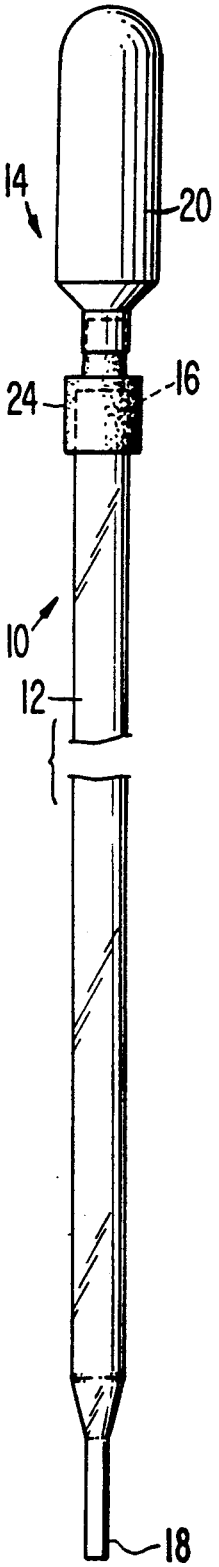
FIG. 1 is an elevation view of a pipette pump according to the principles of the present invention.

Referring first to FIG. 1, a pipette pump 10 of the present invention is illustrated, including a barrel portion 12 and a pump means 14. The barrel 12 may be formed of glass or plastic, such as polystyrene, as is conventional, the barrel portion being a thin walled hollow tube having a first end 16 and a second end 18. The second end 18 is typically tapered and referred to as the tip of the pipette.

The pump means 14 of the invention is illustrated diagrammatically as including a compressible bulb 20 which may be advantageously formed of plastic such as polyethylene or thermoplastic rubber. Although a compressible bulb 20 is illustrated, it should be appreciated that alternate, equivalent mechanical mechanisms may be provided for filling the pipette barrel. By way of example and illustration, but not by way of limitation, a compressible bellows may be utilized or, alternatively, mechanical devices such as a wheel, may be provided to draw liquid up through the pipette barrel.

However, a major distinguishing feature between the present invention and the prior art is the release means or venting means which will now be described. Means 24 is illustrated for interconnecting the bulb 20 of the pump to the first end 16 of the pipette barrel. The interconnecting means 24 is formed as an elongated hollow cylinder having a first end 28 and a second end 30. A shoulder 32 is provided intermediate the first and second ends such that a first portion 34 of the cylinder, between the first end and the shoulder 32, has a first or larger diameter, and a second portion 36 of the cylinder, between the shoulder 32 and the second end 30, has a second diameter, smaller than the first diameter. The larger diameter portion of the interconnecting means is of a size to sealingly, frictionally engage the outside wall of the pipette barrel 12 when the first end 28 of the interconnecting means 24 is placed over the first end 16 of the pipette barrel.

Figure 2:
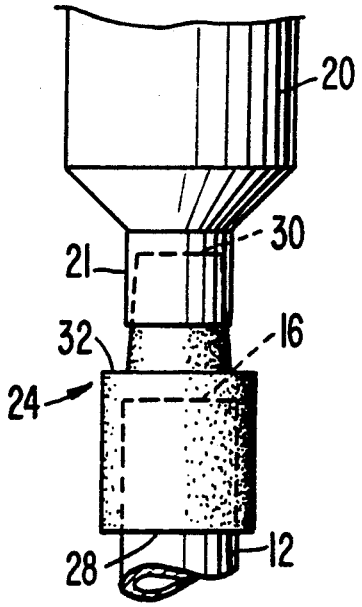
FIG. 2 is an enlarged view of a portion of the pipette of FIG. 1 according to the principles of the present invention.
Figure 3:
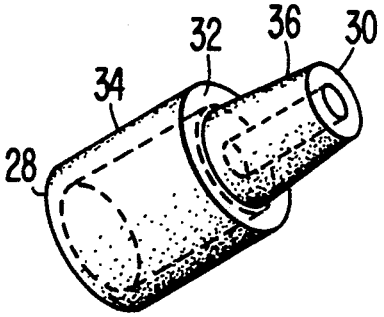
FIG. 3 is a partial perspective illustration of a portion of the pipette of FIG. 1 according to the principles of the present invention.

The interconnecting means 24 is preferably formed of a flexible, resilient material such as Santoprene which is a trademark of Monsanto for a thermoplastic rubber believed to be a butyl rubber. If the interconnecting means 24 is formed independently of the bulb 20, then the diameter of the second end 30 of the interconnecting means is suitably sized such that the bulb 20 and the interconnecting means 24 may be sealingly frictionally retained together. For this purpose, the bulb 20 may include a first end 21 having a circular cross-section. As illustrated in FIGS. 1 and 2, the first end 21 of the bulb fits over the second end 30 of the interconnecting means, and the first end 28 of the interconnecting means fits over the first end 16 of the pipette barrel.

It must be appreciated, however, that the particular configuration is for illustrative purposes only. Thus, even if the interconnecting means 24 is formed independently of the bulb, the interconnecting means has, as its function, to sealingly interconnect the bulb and the pipette barrel, and thus, the relative diameters, the presence of a shoulder on the interconnecting means and the like, are merely to illustrate the principles of the invention.

It should, therefore, be appreciated that an interconnecting means may be provided which is formed integrally with the bulb 20. It is for this purpose that the interconnecting means and bulb are collectively referred to as pump means.

With the bulb 20 and interconnecting means 24 frictionally sealed on the first end 16 of the pipette barrel, the pump means 14 may be actuated, e.g., the bulb 20 may be compressed, for expelling air from the pipette barrel. The pipette tip 18 is then inserted in a fluid, and the pump means 14 released thereby creating a partial suction which draws fluid into the pipette barrel.

Figure 4:
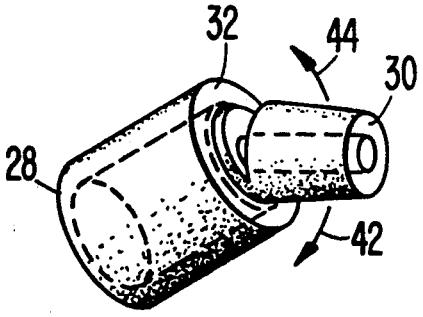
FIG. 4 is a partial perspective partially diagrammatic illustration of part of the present invention.
Figure 5:
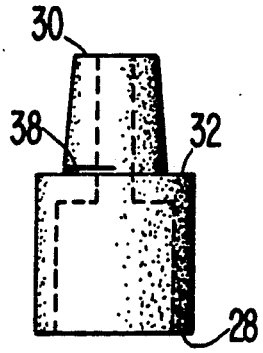
FIG. 5 is an enlarged partial elevation view of a portion of the pipette pump according to the principles of the present invention.

Referring to FIGS. 4 and 5, means are provided for releasing or discharging the contents of the pipette without compressing or actuating the bulb 20. This is accomplished by venting the interior of the pipette barrel to the atmosphere. To further accomplish this, the interconnecting means 24, which is part of the pump means, is provided with a releasing means 38. The preferred form of releasing means is illustrated in FIG. 5 as a transverse slit. Specifically, in the preferred embodiment of the present invention, the shoulder 32 of the interconnecting means is generally parallel to the first and second ends 28, 30, respectively, and all three are generally perpendicular to the elongated axis of the interconnecting means. The releasing means 38 is a transverse slit in the second, or more narrow diameter portion of the interconnecting means just above the level of the shoulder 32. The depth of the slit is exaggerated in FIGS. 4 and 5 for illustrative purposes.

When it is desired to discharge the contents of the pipette barrel, the second cylinder portion 36 is pivoted or tilted relative to the slit in the direction illustrated by the arrow 42. The depth of the slit 38 or releasing means into the wall or thickness of the interconnecting means 24 is sufficient such that when the second cylinder portion 36 is flexed or tilted, a fluid flow path is opened from the barrel through the first portion 34 of the interconnecting means to the atmosphere. Thus, flexing or actuating the releasing means vents the interior of the pipette barrel to the atmosphere. Venting the interior of the pipette barrel to the atmosphere permits the contents of the pipette barrel to be discharged through the pipette tip 1 under the influence of gravity and atmospheric pressure. Stated alternatively, flexing the pump means out of the vertical alignment illustrated in FIGS. 1 and 2, relative to the elongated axis of the pipette barrel, vents the pipette barrel to the atmosphere. This flexing can be accomplished by the laboratory technician holding the pipette barrel near the first end 16, between the second and third fingers and thumb of one hand and moving the bulb 20 using the forefinger of the same hand. Thus, one-hand operation is feasible.

When a desired quantity of fluid has been discharged from the pipette barrel, the releasing means 38 must be closed to seal the pipette barrel from the atmosphere. Again, the laboratory technician may accomplish this using a forefinger by flexing, pivoting or tilting the bulb 20 back into vertical alignment with the longitudinal axis of the pipette barrel. This may be accomplished by moving the smaller diameter portion or second portion 36 of the interconnect means in the direction illustrated by arrow 44 in FIG. 4, thus closing the releasing means 38.

It may be appreciated that in the illustrated embodiment, the interconnect means 24 may be thought of as comprising two cylindrical portions of different diameters interconnected by a shoulder. The two cylindrical portions 34, 36, respectively, are aligned along a common longitudinal axis. Moving one of the cylindrical portions off the common axis serves to vent the interior of the pipette barrel to the atmosphere, thus permitting discharging of the contents of the pipette. Restoring the alignment of the two cylindrical portions closes the vent.

Thus, by manipulating the forefinger, the laboratory technician may dispense the contents of the pipette barrel sequentially in a plurality of aliquots by repetitive tilting and restoring of the second portion 36 of the interconnect means. For this purpose, the interconnecting means is formed of a resilient elastomeric material. The resiliency permits repetitive movement of the second cylindrical portion 36 to alternately vent and close the interior of the pipette barrel relative to the atmosphere.

The interconnecting means 24 may be formed as a portion of the bulb 20 or, alternatively, may be a separate and discrete component. The releasing means or slit 38, when actuated, provides a fluid flow-path between the atmosphere and the pipette barrel. Further, the tilting of the second cylinder portion 36 not only is for venting the pipette barrel contents to the atmosphere but also prevents the bulb 20 from discharging the contents of the pipette barrel. Thus, once the releasing means is tilted as illustrated in FIG. 4, such as to discharge one of several aliquots, even if the bulb 20 is accidentally actuated, air in the bulb will flow out the releasing means 38 rather than into the pipette barrel. Thus, actuation of the releasing means disconnects or by-passes the bulb from the pipette barrel. It should also be appreciated that whenever the releasing means 38 is closed, bulb 20 may be compressed to rapidly expel all (or a portion) of the liquid in the barrel. One particular benefit of rapidly expelling the liquid would be to empty the barrel subsequent to controlled delivery of several aliquots of liquid.

The foregoing is a complete description of a preferred embodiment of the present invention. Many changes and modifications may be made without departing from the spirit and scope of the present invention. The present invention, therefore, should be limited only by the following claims:

What is claimed is:

1. In a pipette pump of the type including a pipette having an elongated hollow barrel with first and second ends, the interior of the barrel defining a first fluid flowpath, and pump means associated with the first end of the barrel, said pump means when actuated causes fluid to be drawn into the second end of the pipette barrel, the improvement in said pump means comprising releasing means actuatable for venting said first end of the barrel to the atmosphere, thereby discharging fluid from said barrel, said releasing means when actuated for further bypassing at least a portion of said pump means for preventing positive displacement discharge of the fluid from said barrel, said releasing means being a normally closed slit, formed in a resilient material.

2. The invention as defined in claim 1 wherein said pump means includes a compressible portion and wherein said releasing means interconnects said pipette barrel to said compressible portion of the pump means.

3. The invention as defined in claim 2 wherein said releasing means is removable from said pipette barrel.

4. The invention as defined in claim 1 wherein said pump means includes an actuatable portion and an interconnecting portion, the interconnecting portion for establishing a fluid flow path between said actuatable and said pipette barrel;

said releasing means slit being formed in said interconnecting portion.

5. The invention as defined in claim 4 wherein said interconnecting portion is an elongated hollow cylinder.

6. The invention as defined in claim 4 wherein said interconnecting portion is an elongated hollow cylinder and said releasing means slit is formed in said elongated hollow cylinder.

7. The invention as defined in claim 1 wherein said releasing means is formed of a resilient, flexible material for selectively discharging the fluid in said barrel in a plurality of aliquots.

8. The invention as defined in claim 1 wherein said pump means includes an actuatable portion aligned with said barrel for filling said barrel, said releasing means for misaligning the actuatable portion of the pump means relative to the barrel.

9. The invention as defined in claim 8 wherein said actuatable portion is aligned relative to the elongated axis of said barrel.

10. The invention as defined in claim 1 wherein said pump means includes an actuatable portion, aligned relative to the elongated axis of said barrel, said releasing means for pivoting said actuatable portion relative to said axis.

11. The invention as defined in claim 1 wherein said pump means provides for positive displacement discharge of the fluid from said barrel when said releasing means is not actuated.

* * * * *